US005987867A

United States Patent [19]

Lang et al.

[11] Patent Number: 5,987,867

[45] Date of Patent: Nov. 23, 1999

[54] FLOOR TEXTILE MATERIAL

[75] Inventors: Aage Lang, Kolind; Jan Lang, Ryomgaard, both of Denmark; Willy DeMeyer, Drongen, Belgium

[73] Assignee: Milliken Denmark A/S, Morke, Denmark

[21] Appl. No.: 08/952,955

[22] PCT Filed: May 17, 1996

[86] PCT No.: PCT/GB96/01189

§ 371 Date: Nov. 24, 1997

§ 102(e) Date: Nov. 24, 1997

[87] PCT Pub. No.: WO96/37645

PCT Pub. Date: Nov. 28, 1996

[30] Foreign Application Priority Data

May 26, 1995 [GB] United Kingdom ..... 9510697
Mar. 16, 1996 [GB] United Kingdom ..... 9605573

[51] Int. Cl.[6] ..... D02G 3/02

[52] U.S. Cl. ..... 57/236; 57/238; 57/242; 57/243; 57/244; 57/250; 57/252

[58] Field of Search ..... 57/236, 238, 242, 57/243, 244, 250, 252, 255; 428/88, 92

[56] References Cited

U.S. PATENT DOCUMENTS

| | | | |
|---|---|---|---|
| 2,508,852 | 5/1950 | Blumfield | 57/238 |
| 2,571,077 | 10/1951 | Underwood et al. | 57/238 |
| 3,158,982 | 12/1964 | Marshall | 57/244 |
| 3,422,615 | 1/1969 | Norman | 57/244 |
| 3,940,522 | 2/1976 | Wessells | 428/17 |
| 4,045,605 | 8/1977 | Breens et al. | 428/88 |
| 4,762,750 | 8/1988 | Girgis et al. | 428/378 |
| 4,771,596 | 9/1988 | Klein | 57/238 |
| 4,808,459 | 2/1989 | Smith et al. | 428/95 |
| 4,820,566 | 4/1989 | Heine et al. | 428/88 |
| 5,055,333 | 10/1991 | Heine et al. | 428/88 |
| 5,209,974 | 5/1993 | Martin et al. | 428/357 |
| 5,284,009 | 2/1994 | Tung et al. | 57/239 |
| 5,786,083 | 7/1998 | Harris | 57/244 |

FOREIGN PATENT DOCUMENTS

| | | | |
|---|---|---|---|
| 64-85341 | 3/1989 | Japan | 57/238 |
| 94/20657 | 9/1994 | WIPO | 57/242 |
| WO 95/30040 | 11/1995 | WIPO . | |

*Primary Examiner*—William Stryjewski
*Attorney, Agent, or Firm*—Terry T. Moyer; Earle R. Marden

[57] ABSTRACT

A yarn for a floor textile material which is comprised of a coarse yarn and a fine yarn twisted together for tufting into a backing material to provide a floor mat. The finer yarn has fibers in the range of 32 to 100 decitex while the coarser yarn has fibers in the range of 110–290 decitex.

12 Claims, 4 Drawing Sheets

*TABLE 3*

| | | | 3M ENHANCE | 3M NOMAD | TUFTON CORAL+ | SCHMIDT ZONE | SCHMIDT HTN | MULDERBEH COIR | | |
|---|---|---|---|---|---|---|---|---|---|---|
| WHAT | TEST | IMP | | | | | | | EXAMPLE 4 | EXAMPLE 3 |
| 1 LIGABS | WATER | 10 | 30 | 0 | 20 | 50 | 40 | 40 | 45 | 40 |
| 2 SCRAPING | DIST+W.1 | 10 | 30 | 10 | 20 | 40 | 15 | 45 | 45 | 50 |
| 3 | DIST+W.2 | 10 | 30 | 0 | 20 | 40 | 50 | 40 | 45 | 50 |
| 4 HIDING | DRY DIRT | 10 | 20 | 50 | 30 | 10 | 50 | 50 | 40 | 40 |
| 5 | IN USE | 10 | 40 | 40 | 30 | 20 | 10 | 20 | 30 | 35 |
| SUBTOTAL FUNCTION | | | 150 | 100 | 120 | 160 | 165 | 195 | 205 | 215 |
| 15 COMPRESS | HEXCOLOUR | 9 | 18 | 41 | 23 | 23 | 23 | 0 | 23 | 27 |
| 16 | HEXSTRUCT | 9 | 18 | 45 | 32 | 18 | 18 | 0 | 18 | 23 |
| 17 | HEXTHICKN | 9 | 9 | 45 | 27 | 27 | 27 | 0 | 27 | 27 |
| 18 ABRASION | LISSON | 9 | 27 | 0 | 27 | 9 | 9 | 0 | 36 | 45 |
| SUBTOTAL LIFETIME | | | 72 | 131 | 109 | 77 | 77 | 0 | 104 | 122 |
| TOTAL PERFORMANCE | | | 222 | 231 | 229 | 237 | 242 | 195 | 309 | 337 |

PERFORMANCE IS RATED FROM 1 TO 5, 5 BEING THE BEST
THAT PERFORMANCE IS THEN MULTIPLIED BY THE IMPORTANCE RATING (CUSTOMER).
TEST AFTER CLEANING

*TABLE 1*

| | EXAMPLE 1 TEST MAT | 3M NORMAL | SMIDT MAT NOODLE LOOP | ASTRO TURF ASTRO TURF |
|---|---|---|---|---|
| WASHFASTNESS | WASHABLE | NOT WASHABLE | NOT WASHABLE | NOT WASHABLE |
| | | | | |
| TUFT LOCK, lb__ | 3,73 | 1,94 | 1,5 | NOT APPLICABLE |
| | | | | |
| WATER TRANSPORTATION OVER MAT`50 WALK CYCLES | 6 g. | 123 g. | 148 g. | 268 g. |
| WATER TRANSPORTATION FROM WET MAT`50 WALK CYCLES | 20 g. | 58 g. | 164 g. | 42 g. |

*FIG. –1A–*

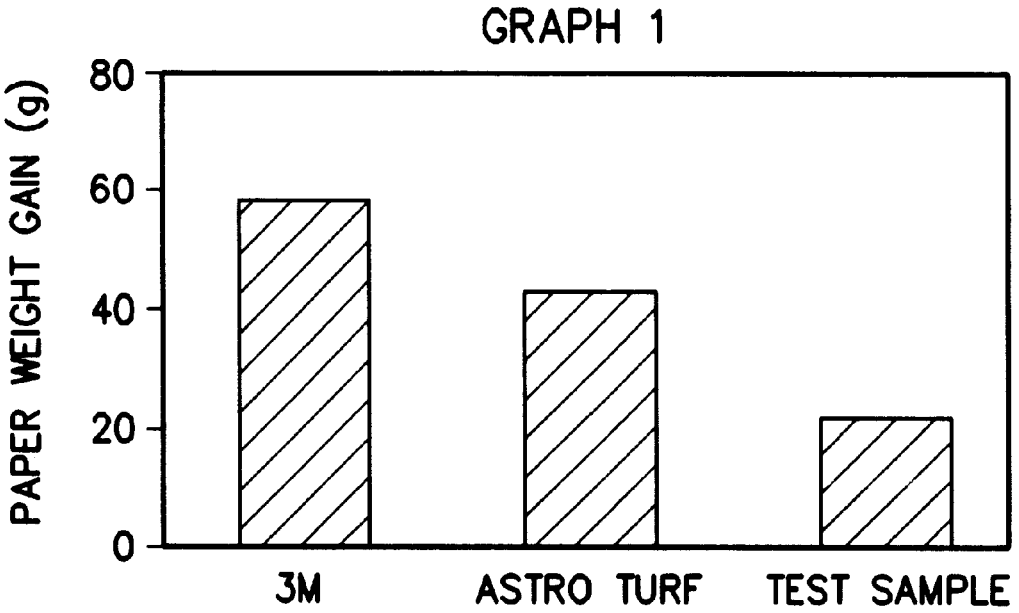
*FIG. –1B–*
0
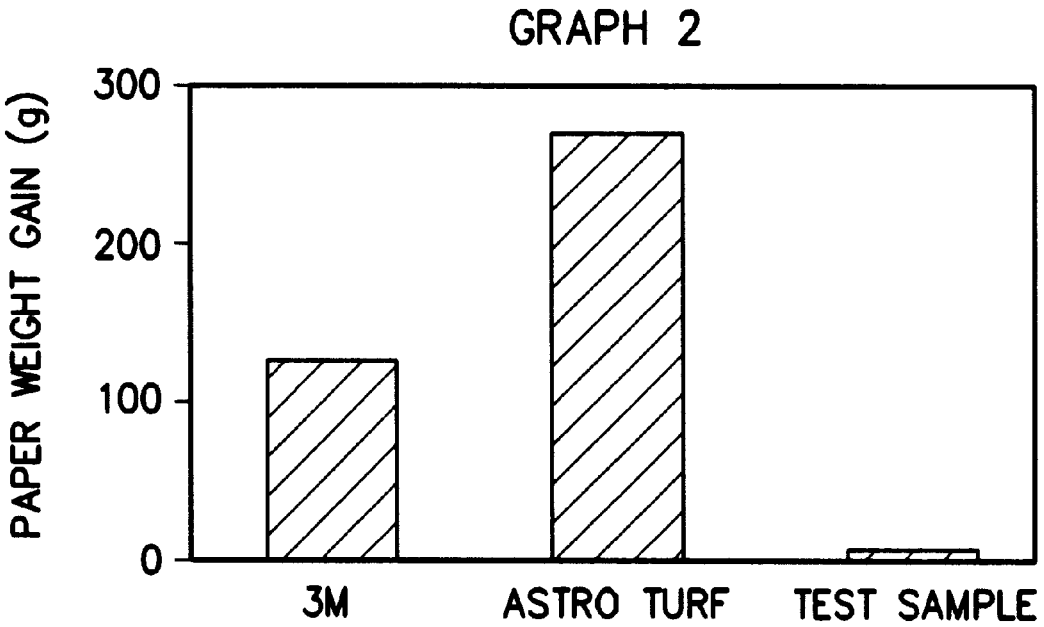
*FIG. –1C–*

*TABLE 2*

| REFERENCE | NUMBER OF REVOLUTIONS | COLOUR CHANGE | STRUCTURE CHANGE | MEAN THICKNESS LOSS AFTER 4,000 REVS (%) |
|---|---|---|---|---|
| 3M ENHANCE (A) | 4,000<br>12,000 | 3<br>2 | 3<br>2 | 23.9 |
| 3M NOMAD (B) | 4,000<br>12,000 | 4–5<br>4–5 | 5<br>5 | 3.6 |
| TUFTON CORAL (C) | 4,000<br>12,000 | 3<br>2–3 | 4<br>3–4 | 15.2 |
| SCMIDT ZONE (D) | 4,000<br>12,000 | 3<br>2–3 | 3<br>2 | 11.4 |
| EXAMPLE 4 (E) | 4,000<br>12,000 | 3–4<br>2–3 | 2–3<br>2 | 9.9 |
| EXAMPLE 3 ( F) | 4,000<br>12,000 | 3–4<br>3 | 3<br>2–3 | 11.5 |

*FIG. –2–*

TABLE 3

| | | | 3M ENHANCE | 3M NOMAD | TUFTON CORAL+ | SCHMIDT ZONE | SCHMIDT HTN | MULDERBEH COIR | | |
|---|---|---|---|---|---|---|---|---|---|---|
| WHAT | TEST | IMP | | | | | | | EXAMPLE 4 | EXAMPLE 3 |
| 1 LIGABS | WATER | 10 | 30 | 0 | 20 | 50 | 40 | 40 | 45 | 40 |
| 2 SCRAPING | DIST+W.1 | 10 | 30 | 10 | 20 | 40 | 15 | 45 | 45 | 50 |
| 3 | DIST+W.2 | 10 | 30 | 0 | 20 | 40 | 50 | 40 | 45 | 50 |
| 4 HIDING | DRY DIRT | 10 | 20 | 50 | 30 | 10 | 50 | 50 | 40 | 40 |
| 5 | IN USE | 10 | 40 | 40 | 30 | 20 | 10 | 20 | 30 | 35 |
| SUBTOTAL FUNCTION | | | 150 | 100 | 120 | 160 | 165 | 195 | 205 | 215 |
| 15 COMPRESS | HEXCOLOUR | 9 | 18 | 41 | 23 | 23 | 23 | 0 | 23 | 27 |
| 16 | HEXSTRUCT | 9 | 18 | 45 | 32 | 18 | 18 | 0 | 18 | 23 |
| 17 | HEXTHICKN | 9 | 9 | 45 | 27 | 27 | 27 | 0 | 27 | 27 |
| 18 ABRASION | LISSON | 9 | 27 | 0 | 27 | 9 | 9 | 0 | 36 | 45 |
| SUBTOTAL LIFETIME | | | 72 | 131 | 109 | 77 | 77 | 0 | 104 | 122 |
| TOTAL PERFORMANCE | | | 222 | 231 | 229 | 237 | 242 | 195 | 309 | 337 |

PERFORMANCE IS RATED FROM 1 TO 5, 5 BEING THE BEST
THAT PERFORMANCE IS THEN MULTIPLIED BY THE IMPORTANCE RATING (CUSTOMER).
TEST AFTER CLEANING

FIG. -3-

FLOOR TEXTILE MATERIAL

BACKGROUND OF THE INVENTION

The present invention relates to a floor textile, and more particularly to a cleanable dirt control textile which may be used for mats and for runners.

Mats are generally used in access ways where people tend to brush or scrape their feet in order to prevent carrying of moisture and/or dirt, accumulated on their footwear, into other areas of the premises. Normally these mats are located in areas of high pedestrian traffic, such as doorways. similarly, runners (for example, long carpets in hotel corridors) have to cope with high pedestrian traffic.

Mats or runners may be produced as roll goods from which individual mats or runners can be prepared. Generally it is preferable that mats and runners have the appearance of conventional carpeting. In this market a rustic enhanced surface is required which ensures lasting rigid fibres whilst retaining an acceptable appearance. It has previously been proposed to provide floor textile material having the general appearance and feel of carpeting, but which allows for improved cleaning and may have the added feature of having a dirt scraping effect.

British Patent Number 1527622 relates to a carpeting material which comprises pile or tuft fibres which comprise yarns of first carpet fibres along with second fibres or filaments which are not part of said yarns and are stiffer than the yarns and can act as dirt scrapers.

It is desirable that floor textile material of this kind should be capable of being thoroughly cleaned for example, by washing. In British Patent Application Number 2279247 it was stated that the form of materials disclosed in GB Patent 1527622 created a problem because, during washing the stiff fibres tend to be washed out of the carpet material.

British Patent Application Number 2279247 was concerned with solving this problem and disclosed a method for forming a washable scraper carpet including the steps of bringing a length of the scraper floor textile material into contact with a corresponding length of un-cured rubber material, applying heat to the un-cured rubber material for a short period at a temperature between 80° C. and 120° C. to enable the rubber viscosity to reduce to a level where the rubber material can flow round the stiff fibres, and applying heat and pressure to the floor textile material to enable the rubber material to laminate the carpet fibre material, so as to be cured, and to bond to the mono-filaments and form a backing.

The method described in Patent Application Number 2279247 overcomes the problem of stiff fibres tending to be washed out of the floor textile material during laundering, but provides a method which is complicated, requires high temperatures for operation, and cannot be directly substituted into conventional methods for making carpet material.

The present invention aims to overcome the disadvantages with the prior art.

BRIEF SUMMARY OF THE INVENTION

According to the present invention there is provided a yarn suitable for use in making a cleanable dirt control textile, comprising at least two sets of fibres which have been twisted together, the first set comprising fibres of 32 to 100 decitex, the second set comprising fibres of 110 to 290 decitex, wherein finished yarn is of 6000–9800 decitex.

According to the present invention there is provided a floor textile material comprising pile or tuft which comprises yarn which consists of two sets which have been twisted together, the first set comprising fibres of 32 to 100 decitex, the second set comprising fibres of 110 to 290 decitex, wherein the finished yarn is of 6000–9800 decitex.

Preferably, the yarn comprises fibres of polypropylene, Nylon 6 or Nylon 6.6. Most preferably, polypropylene fibres are used.

Preferably, the first set of fibres are of 32 to 40 decitex.

Preferably, the second set of fibres are of 285 to 290 decitex.

Preferably, the yarn contains a total of from 3 to 8 fibres.

In a floor textile material according to the present invention where the yarn has been twisted with a mixture of different decitex fibres a rigid, lasting pile may be achieved which may allow for improved cleaning function as compared with existing products employed for the same purpose.

The integration of the fibres having decitex values in the ranges stated above into a final yarn may provide a textile material which may act as a dirt scraper and has improved function in terms of accumulation of dirt and water. Due to the integration, problems with fibres being washed out does not occur.

The backing material may be latex, rubber, PVC, thermoplast or thermoplastic elastomer and the use of uncured rubber and/or a two step process is not essential.

Preferably the yarn is twisted with 140–260 turns per metre.

Floor textile material according to the present invention uses a mixture of high decitex fibres within the ranges specified above which are integrated with low decitex fibres within the range specified above into one yarn. Thus there are no separate yarns in the mat, just a uniformed surface results.

The yarn can be heat set to a straight saxony look. The carpet material can be UV protected for indoor and outdoor use.

Carpet material according to the present invention accumulates both dirt and water.

Yarn is formed using continuous filament fibre, preferably of a heat set type. The fibres may be UV protected.

For formation of a yarn for use in making textile material according to the present invention fibres from each of the aforementioned decitex ranges may be combined and constructed to a twisted and heat set form where the fibres consist of a mixture of 32 to 100 and of 110 to 290 decitex per yarn filament. The yarn may be twisted to 140–260 turns per metre resulting in yarn of 6000–9800 decitex. For this process conventional heat setting equipment may be used (SUPERBA (TM) or SUESSEN (TM)). The final yarn is of a continuous straight and rigid form.

For the formation of a mat, conventional tufting machines can be used using cut, loop or cut-loop type/designs in different gauges (5/32") to achieve a pile height of between 5–15 mm and a stitch rate of 15–30 stitches per 10 cm. The yarn of 6000–9800 decitex may be tufted into a primary backing of non-woven, woven or spun bonded fabric. To form a mat the yarn tufted primary backing may be attached to a backing of latex, rubber, pvc, thermoplastic or thermoplastic elastomer.

Embodiments of the inventions and tests involving them are outlined in the following nonlimiting examples with to the figures and tables wherein,

BRIEF DESCRIPTION OF THE DRAWINGS

FIG. 1A presents Table 1 giving a comparison in water transportation across different mats.

FIG. 1B presents Graph 1 illustrating results of step test over 3 mats.

FIG. 1C presents Graph 2 illustrating results of step test over 3 mats.

FIG. 2 presents Table 2 indicating properties of various mats.

FIG. 3 presents Table 3 indicating function and lifetime performance comparisons for a range of mats.

DETAILED DESCRIPTION OF THE DRAWINGS

One embodiment of the invention is described in the Example 1 and its performance illustrated as outlined in Example 2 and in the accompanying Graphs 1 and 2 (FIG. 1B). A comparison between the mat of Example 1 and other mats is given on Table 1 (FIG. 1A). Two further embodiments are described in Examples 3 and 4 with associated test results for these embodiments outlined in Example 5.

EXAMPLE 1

Two polypropylene fibres of 32 decitex were mixed with 2 fibres of 285 decitex and twisted to 200 turns per metre resulting in yarn fibres of 8600 decitex after heat setting with SUPERBA (TM) heat setting equipment.

To form a mat a cut type tufting machine was used at (5/32") gauge to achieve a height of approximately 8 mm at a stitch rate of 19 stitches per 10 cm and the yarn was tufted into a primary backing of spun bonded fabric of polypropylene (Typar 3409-s 133 g/m) in 150 cm width.

The yarn tufted primary backing was attached to a backing of NBR latex with 600 g/m$^2$ using a roller technique.

EXAMPLE 2

Comparison of efficiency of a material according to the present invention against other materials.

A mat formed according to Example 1 was tested against a NOMAD (TM) mat produced by 3M and against ASTRO TURF to measure the ability of a mat according to the present invention to accumulate water. In each case the dimensions of the mat were 80 cm×120 cm.

In Test 1 a mat of each of the materials to be tested was placed in front of a sheet of paper. Two litres of water were poured on the mat.

In Test 2 a tray containing 1 litre of water was placed in front of a mat of each material to be tested which in turn was in front of a sheet of paper.

Walkers crossed the mat and the sheet of paper fifty times, each time stepping three times on the mat and two times on the paper. In Test 2 the walkers stepped in the tray of water each time before stepping onto the mat.

After each test, the paper was weighed to measure the amount of water which had been transferred from the mat to the paper. The results are shown in Graph 1 and 2 (FIG. 1B), Graph 1 relating to Test 1 and Graph 2 relating to Test 2. In each case, the mat material is indicated on the x-axis and the weight gain in the paper is indicated in grams on the y-axis.

In each case, the tested textile material held the water better than the 3M mat or the ASTRO TURF, indicating that accumulation of dirt and water in a mat according to the present invention is more efficient than in the other materials tested.

Further comparative tests involving the mat of Example 1 are reported in Table 1 (FIG. 1A).

EXAMPLE 3

A yarn was produced having a 4 ply construction consisting of 2 plies of 2700/68/40 dpf and 2 plies of monofilament 290 dtex/0.18 mm. These 4 plies were twisted together at 160 turns per metre and heat set at a temperature of 138° C. on SUPERBA (TM) heat setting equipment, giving a yarn 7293 dtex after heat setting.

The yarn was tufted on non woven substrate (110–150 g/m$^2$) to a total weight of 850 g/m$^2$ to 880 g/m$^2$ on a 5/32" gauge tufting machine. Pile height was approximately 9 mm.

Mats were produced in 4 metre width and a latex backing was applied before slitting the 4 metre width into rolls of 2 metres. The backing thickness is approximately 2 mm, thereby giving a total product height of limm in use. Rubber or PVC can equally well be used as backing in place of latex.

EXAMPLE 4

A yarn was produced having a 3 ply construction consisting of 2 plies of 2700/68/40 dpf and 1 ply of monofilament 290 dtex/0.18 mm.

These plies were twisted together and heatset as described for Example 3 giving a yarn of 6988 dtex after heatsetting.

Mats were produced as described for Example 3.

EXAMPLE 5

Tests on Six Samples of Barrier Mats

Mats

Six samples of barrier mats, each sample comprising two pieces, measuring approximately 85 cm×150 cm were tested. These were:

Mat

3M Enhance (A)

3M Nomad (B)

Tufton Coral (C)

Scmidt Zone (D)

Example 4 Mat (E)

Example 3 Mat (F)

Hexapod Test and Lisson Tretrad Test were carried out on the samples supplied.

The samples were conditioned and tested in the standard atmosphere for conditioning and testing textiles (BS EN20139:1992) of 65+2%r.h. and 20$^{+}$2° C.

Assessment of the change in Surface Structure and Colour of Textile Ploorcoverings—Hexapod Test One specimen from each sample was fatigued for 4,000 revs. and a second specimen for 12,000 revs. in a Hexapod Tumbler Tester, in accordance with BS 6659:Part 2:1986. The specimens were vacuumed at every 2,000 revs. and before grading using a commercial upright vacuum cleaner.

Each specimen was assessed for change in surface structure and colour separately in accordance with BS 6659:Part 1:1986. The thickness was measured in five places within the central band, using the method described in BS 4051:1987, before and after fatiguing to 40,000 revs. The thickness loss was calculated as a percentage of the total carpet thickness.

| | |
|---|---|
| 5 | No change |
| 4 | Slight change |
| 3 | Moderate change |
| 2 | Considerable change |
| 1 | Severe change |

Colour was assessed using large size standard grey scales. The results are presented in Table 2 (FIG. 2).

Lisson Tretrad Test

Two specimens from each sample were tested on a Lisson Tretrad for 1720 passages, in accordance with DIN 54322. The mean absolute weight loss for each sample was calculated.

| Reference | Mean Weight Loss (g) |
|---|---|
| 3M Enhance (A) | 1.3 |
| 3M Nomad (B) | 2.7(*) |
| Tufton Coral (C) | 1.8 |
| Scmidt Zone (D) | 7.8 |
| Example 4 (E) | 0.6 |
| Example 3 (F) | +0.9 |

(*) The surface of the nosing of both specimens started to break up after 500 passages.

Between 500 and 1000 passages, the rest of each specimen started to break up, ie fragments breaking off.

At the end of the test, the nosing of both specimens had worn away.

Other Tests

Comparisons of the performance of the mats produced according to Examples 3 and 4 with other known mats are given in Table 3 (FIG. 3).

We claim:

1. A yarn suitable for use in making a cleanable dirt control textile, said yarn comprising a first set of fibres which has been twisted together with at least a second set of fibres to form a finished yarn, the first set comprising fibres of 32 to 100 decitex, the second set comprising fibres of 110 to 290 decitex, wherein said finished yarn is of 6000–9800 decitex.

2. A yarn as claimed in claim 1, wherein the first set of fibres are of about 32 to 40 decitex.

3. A yarn as claimed in claim 1, wherein the second set of fibres are of about 285 to 290 decitex.

4. A yarn as claimed in claim 1, wherein the yarn contains a total of from 3 to 8 fibres.

5. A yarn as claimed in claim 1, wherein the yarn is twisted with about 140–260 turns per meter.

6. A yarn as claimed in claim 1, wherein at least one of said first set or second set of fibres comprises continuous filament fibre.

7. A yarn as claimed in claim 1, wherein the yarn is of a heat set type.

8. A yarn as claimed in claim 1, wherein at least a portion of the fibres are protected against ultraviolet degradation.

9. A floor textile material comprising a plurality of surface yarns; said surface yarns comprising a first set of fibres of about 32 to 100 decitex twisted together with at least a second set of fibres of about 110 to 290 decitex, said surface yarn having a linear density of 6000–9800 decitex.

10. A floor textile material as claimed in claim 9, further comprising a backing material selected from the group consisting of latex, rubber, PVC, thermoplastic and thermoplastic elastomer.

11. A floor textile material as claimed in claim 9 wherein the yarn is heat set to a straight saxony look.

12. A floor textile material as claimed in claim 9 wherein at least a portion of said fibres forming said surface yarns are protected against ultraviolet degradation.

* * * * *